US007051988B2

(12) United States Patent
Shaw et al.

(10) Patent No.: US 7,051,988 B2
(45) Date of Patent: May 30, 2006

(54) BRACE FOR CONCRETE FORMS

(75) Inventors: Scott Shaw, San Juan Capistrano, CA (US); Kenneth Lee, Anaheim, CA (US); Martin E. Lancial, Yucaipa, CA (US); John Gilner, Redlands, CA (US); Clifford D. Bennett, Alta Loma, CA (US)

(73) Assignee: Dayton Superior Corporation, Dayton, OH (US)

( * ) Notice: Subject to any disclaimer, the term of this patent is extended or adjusted under 35 U.S.C. 154(b) by 0 days.

(21) Appl. No.: 10/425,519

(22) Filed: Apr. 29, 2003

(65) Prior Publication Data

US 2004/0007652 A1 Jan. 15, 2004

Related U.S. Application Data

(60) Provisional application No. 60/394,502, filed on Jul. 9, 2002.

(51) Int. Cl.
*E04G 17/00* (2006.01)

(52) U.S. Cl. ..... 249/219.1; 249/3; 248/309.1; 248/354.2; 52/169.1; 52/149

(58) Field of Classification Search ..... 249/2, 249/43, 4, 5, 6; 248/200, 235, 201, 226, 248/236, 238; 52/169.7; 4/506
See application file for complete search history.

(56) References Cited

U.S. PATENT DOCUMENTS 939,005 A 11/1909 Goedeke
1,349,340 A * 8/1920 Hotchkiss ..... 249/3
1,682,008 A 8/1928 Heltzel
1,690,295 A * 11/1928 Heltzel ..... 249/6
1,722,144 A 7/1929 Heltzel
1,944,511 A * 1/1934 Heltzel ..... 249/6
2,313,880 A * 3/1943 Leggett, Sr. ..... 249/27
2,727,712 A * 12/1955 Holmboe ..... 248/357
2,738,563 A * 3/1956 Steele ..... 249/195
2,875,500 A 3/1959 Stough ..... 25/118
2,891,759 A * 6/1959 Holmboe, Sr. ..... 248/357
2,917,803 A * 12/1959 Phillips ..... 249/6
2,991,532 A 7/1961 Stiles ..... 25/118
3,428,287 A * 2/1969 Redding et al. ..... 249/13
3,444,659 A * 5/1969 Shanni ..... 52/149
3,922,135 A * 11/1975 Haller et al. ..... 425/432
4,068,427 A * 1/1978 Camardo ..... 52/127.2
4,101,111 A 7/1978 Bishop ..... 249/205
4,104,356 A 8/1978 Deutsch et al. ..... 264/297
4,124,907 A * 11/1978 Laven ..... 52/169.7
4,290,985 A * 9/1981 Barale ..... 264/31
4,339,106 A * 7/1982 Navarro ..... 249/219.1
4,393,568 A 7/1983 Navarro ..... 29/432
4,464,802 A * 8/1984 Glonek et al. ..... 4/506
4,996,770 A * 3/1991 McCracken ..... 29/897.34
5,076,536 A 12/1991 Fitzgerald ..... 249/219.1
5,096,155 A 3/1992 Fitzgerald ..... 249/219.1

(Continued)

*Primary Examiner*—Anita M. King
(74) *Attorney, Agent, or Firm*—Wood Herron & Evans, LLP

(57) ABSTRACT

A brace for securing concrete form members to a casting surface. First and second leg members are spaced to form an angle. A bridging member extends between opposing ends of the leg members and a strut extends between the joined ends of the leg members and the bridging member. The bridging member and strut form a truss, together with raised ribs along the legs and bridging member. The brace may be molded from plastic as a one-piece structure.

23 Claims, 3 Drawing Sheets

U.S. PATENT DOCUMENTS 5,491,948 A 2/1996 Harris ..... 52/596
5,656,194 A 8/1997 Zimmerman ..... 249/160
5,667,190 A 9/1997 Scott et al. ..... 249/16
5,702,627 A 12/1997 Brasken ..... 249/33
5,732,918 A * 3/1998 Steele et al. ..... 248/237
5,771,643 A 6/1998 Parker ..... 52/169.5
5,817,247 A * 10/1998 Colatruglio ..... 249/4
5,843,327 A * 12/1998 Lindgren ..... 249/210
5,897,816 A * 4/1999 Johnson ..... 264/35
6,182,416 B1 2/2001 Brackin ..... 52/745.09
6,186,469 B1 2/2001 Scott ..... 249/16
6,195,956 B1 3/2001 Reyneveld ..... 52/745.19
6,230,451 B1 * 5/2001 Stoller ..... 52/169.1
6,352,237 B1 * 3/2002 Severino ..... 249/194
6,540,201 B1 4/2003 Gagnon et al.
6,698,702 B1 * 3/2004 Macri et al. ..... 248/237
6,834,471 B1 * 12/2004 Takagi et al. ..... 52/699
2002/0073634 A1 * 6/2002 Bolinger et al. ..... 52/127.2
2002/0145093 A1 * 10/2002 Shaw et al. ..... 248/235

* cited by examiner

BRACE FOR CONCRETE FORMS

CROSS REFERENCE TO RELATED APPLICATION

Pursuant to 37 C.F.R. § 1.78(a)(4), this application claims the benefit of and priority to prior filed Provisional Application Ser. No. 60/394,502, filed Jul. 9, 2002, now abandoned which is expressly incorporated herein by reference.

FIELD OF THE INVENTION

This invention relates to concrete construction materials, and more particularly to a brace for securing concrete forms to a casting surface.

BACKGROUND OF THE INVENTION

Concrete wall panels are conventionally used in the construction of industrial buildings and other structures. In general, individual concrete wall panels are formed at the construction site by pouring concrete into forms which have been assembled on a casting surface, such as the floor of the building where the wall panels will be used. The concrete forms are typically secured to the casting surface by braces which hold the forms in place until the concrete wall panel has cured. The concrete forms are typically made of wood and the braces are often nailed to the forms and the casting surface. When the wall panel has cured, the nails and braces are removed from the forms and the casting surface, and the concrete panel is then raised to a desired position. Thereafter, the forms may be reused to cast another concrete wall panel.

Prior braces for securing concrete forms include wooden blocks and steel braces. The wooden blocks are typically saw cut into a triangular shape and are not always dimensionally uniform. These wooden blocks are usually damaged upon removal from the concrete forms, thereby hindering the removal of nails used to secure the wooden blocks to the forms. Prior steel braces are generally reusable, but are also generally more expensive than wooden blocks. Because they are made from steel, these braces are considerably heavier, making it difficult to carry and handle the steel braces.

There is thus a need for a brace which can be used to secure concrete forms at a work site and which overcomes drawbacks of the prior art, such as those described above.

SUMMARY OF THE INVENTION

The present invention provides an improved brace for securing the form members of a concrete form to a casting surface. The brace can be molded from plastic and includes truss reinforcing elements which lend strength and durability to the brace. In an exemplary embodiment, first and second leg members of the brace are joined at one end and are spaced apart to form an angle, wherein one of the leg members may engage a portion of a concrete form and the other leg member may engage the casting surface. A bridging member extends between the leg members to add strength to the brace. The brace may be secured to the concrete forms and the casting surface by driving nails through apertures which are formed in the ends of the leg members.

In another exemplary embodiment, the brace further includes a strut which extends between the leg members and the bridging member. Enlarged portions of the brace near the ends of the leg members facilitate the installation of fasteners to secure the brace to the form members and to the casting surface. In another exemplary embodiment, raised ribs extend along the leg members and the bridging member to add further strength to the brace.

In another exemplary embodiment, the brace further includes one or more reinforcing members extending between the strut and intermediate portions of the first and second leg members. In yet another exemplary embodiment the brace may include a web which extends between the first and second leg members and the bridging member to fill the area bounded by these members.

Advantageously, the braces may be formed from plastic and are thus very light weight and easy to handle. The braces may be formed in mass quantities to have a uniform shape, whereby more consistent results in forming the concrete panels may be achieved.

In another exemplary embodiment, a construction assembly includes a concrete form arranged on a casting surface and at least one molded plastic, truss-reinforced brace affixed to an outer portion of the concrete form.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
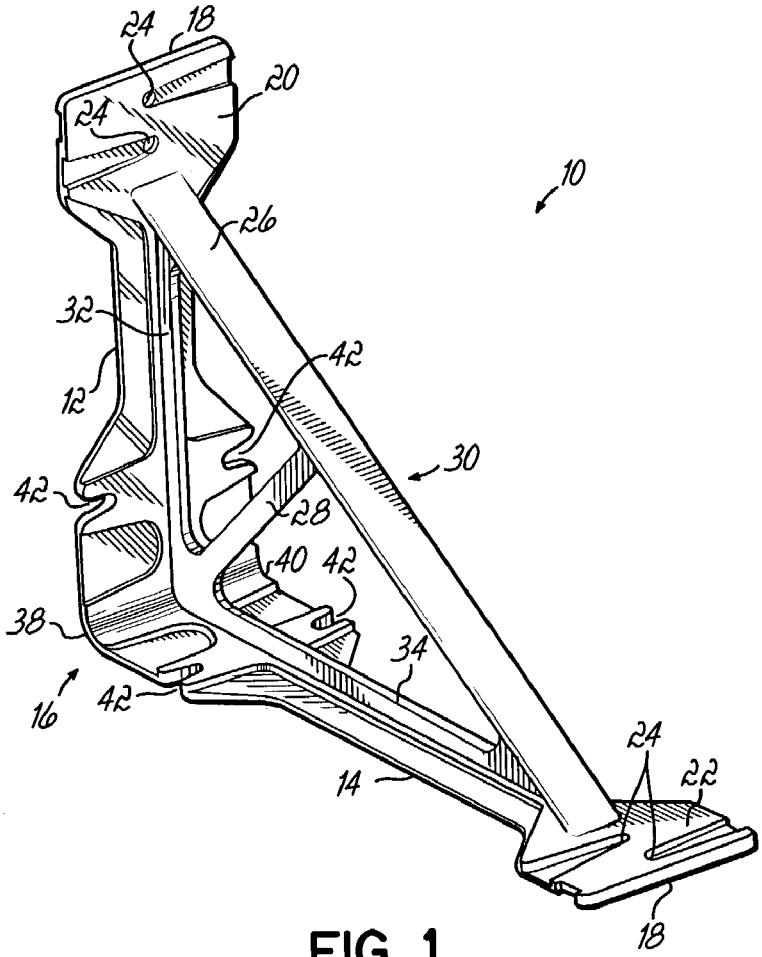
FIG. 1 is a perspective view of an exemplary brace of the present invention.
Figure 2:
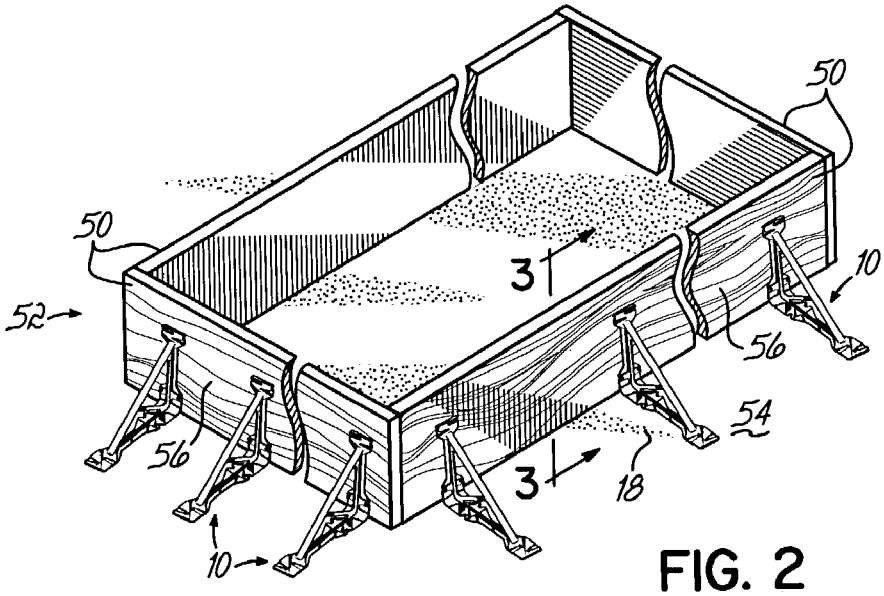
FIG. 2 is a perspective view of a construction assembly including the exemplary brace of FIG. 1.
Figure 3:
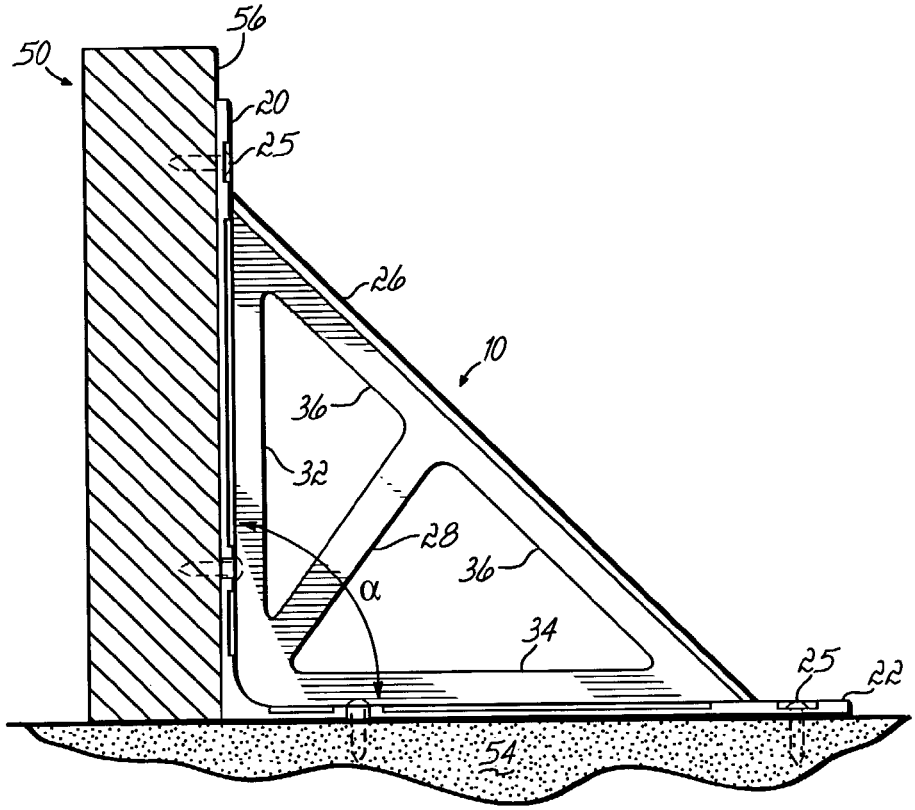
FIG. 3 is a section view of the construction assembly of FIG. 2 taken along line 3—3.

Referring to FIGS. 1–3, there is shown an exemplary brace 10 of the present invention. Brace 10 includes first and second leg members 12, 14, joined at first ends 16 of the leg members 12, 14 and spaced from one another to form an angle $\propto$. The second ends 18 of the leg members 12, 14 have enlarged portions 20, 22 with apertures 24 sized to receive fasteners 25 whereby the first leg member 12 may be positioned adjacent an outer surface of a concrete form 52 and the second leg member may be positioned adjacent a casting surface 54 for creating a concrete wall panel. The brace 10 further includes a bridging member 26 which extends between the second ends 18 of the first and second leg members 12, 14 to add durability to the brace 10. A strut 28 extends between the joined, first ends 16 of the leg members 12, 14 and an intermediate portion of the bridging member 26, whereby the bridging member 26 and the strut 28 form a truss section 30 of the brace 10. First and second raised ribs 32, 34 extend along the first and second leg members 12, 14, respectively, and a third raised rib 36 extends along the bridging member 26 to further improve the strength of the brace 10. First and second flange portions 38, 40 near the first ends 16 of the leg members 12, 14 and on opposite sides of the raised rib portions 32, 34 include slots 42 formed therein to provide additional locations for fastening the brace 10 to the concrete form and to the casting surface.

Advantageously, the brace 10 may be molded as a single-piece plastic member to provide a lightweight and inexpensive brace for securing concrete forms. Due to its molded construction, the brace 10 may be made uniform in shape to ensure consistent results when used with concrete forms to create concrete wall panels. Being lightweight, the braces 10 may be easily carried in bulk to a work site and are easy to handle. Because the braces 10 are relatively inexpensive, they may be used as disposable items at the work site.

Referring to FIGS. 2 and 3, the exemplary brace 10 of FIG. 1 may be used to secure the form members 50 of a concrete form 52 to a casting surface 54 so that a concrete panel may be created on the casting surface 54. The brace 10 may be secured to an outer portion 56 of the form members 50 such as by nailing or screwing the brace 10 to the form member 50 through the apertures 24 provided in the enlarged portion 20 of the first leg member 12 and slots 42 provided on the flange portions 38, 40. Likewise, the brace 10 may be secured to the casting surface 54 by nailing or screwing the brace 10 through the apertures 24 and slots 42 provided on the enlarged portion 22 and flange portions 38, 40 of the second leg member 14.

Figure 4:
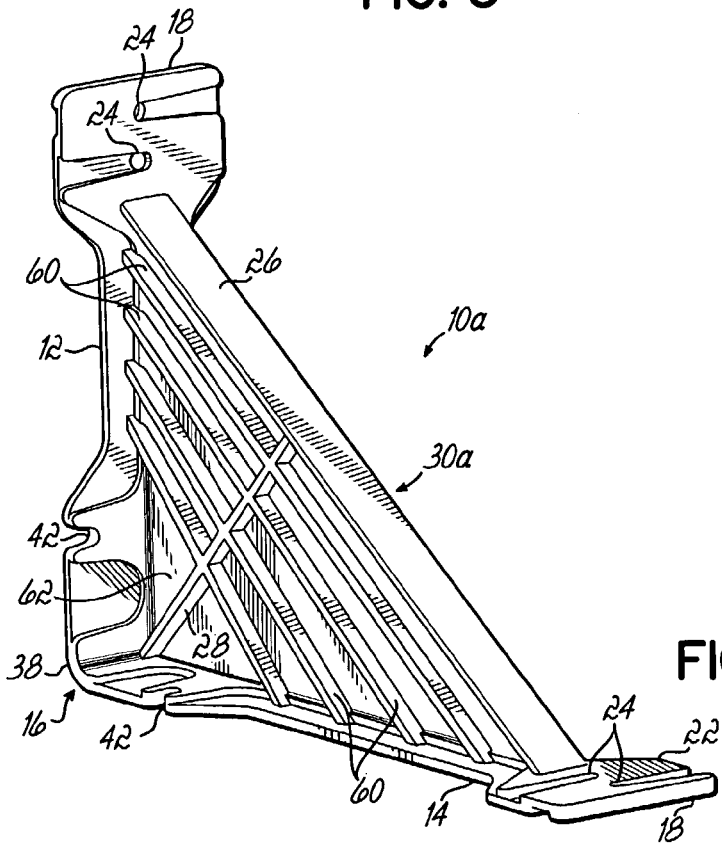
FIG. 4 is a perspective view of another exemplary brace of the present invention.
Figure 5:
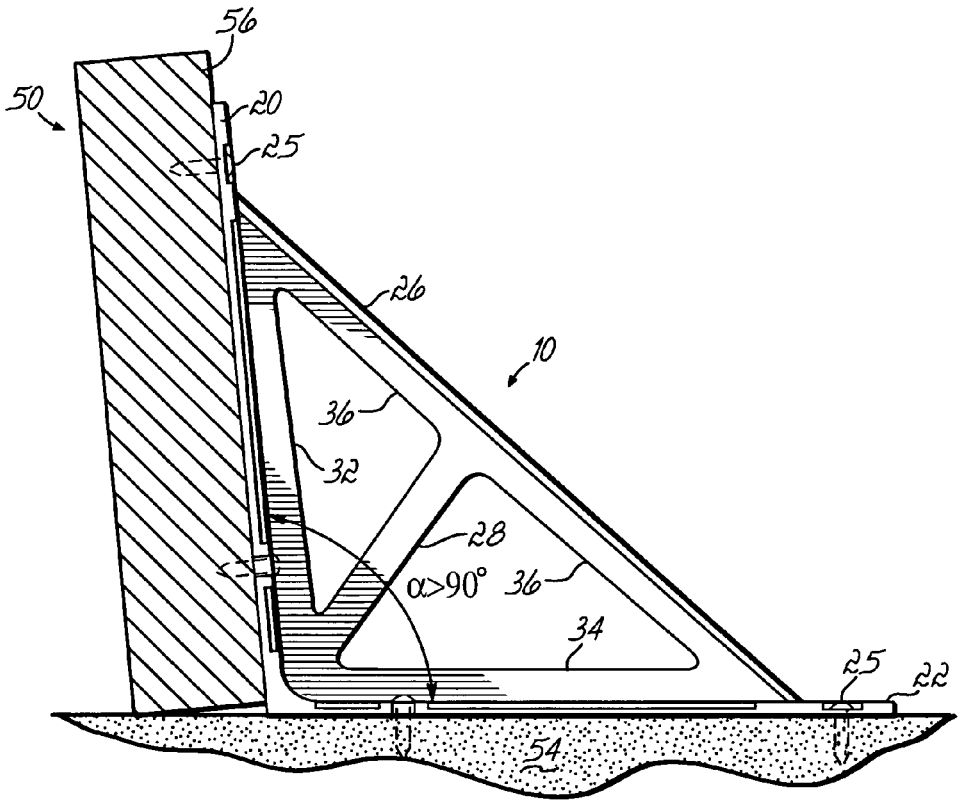
FIG. 5 is a section view, similar to FIG. 3, depicting a second exemplary brace of the present invention.
Figure 6:
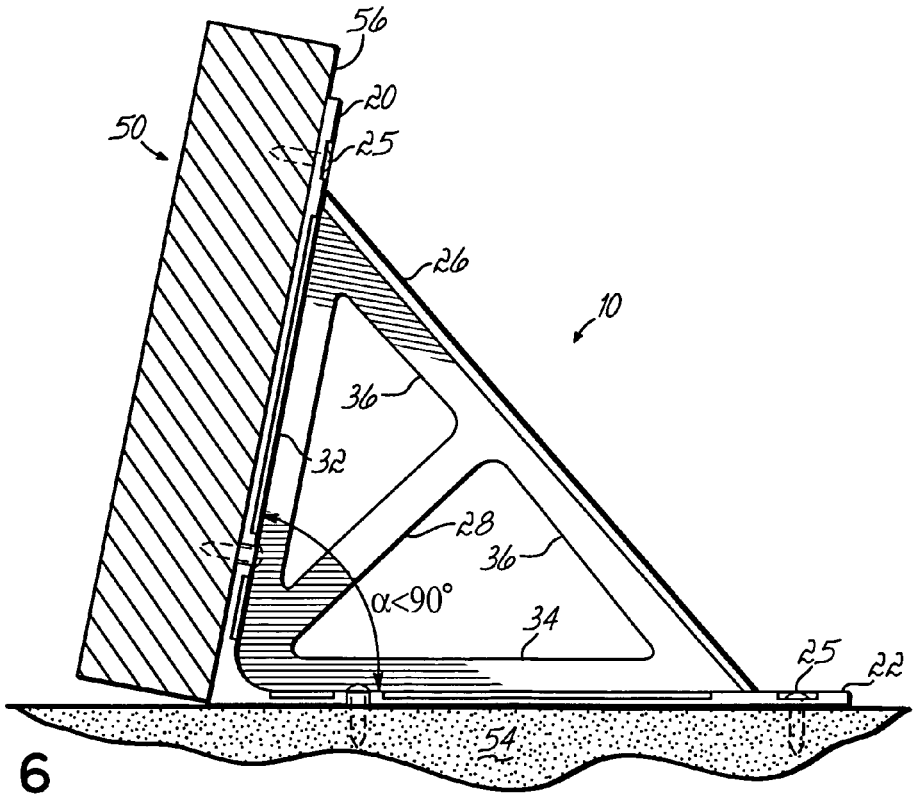
FIG. 6 is a section view, similar to FIG. 3, depicting a third exemplary brace of the present invention.

With reference to FIG. 4, there is shown another exemplary brace 10*a* of the present invention, wherein features commonly shared with the exemplary brace 10 of FIGS. 1 and 2 are numbered accordingly. As shown in FIG. 4, brace 10*a* may include one or more generally elongate reinforcing members 60 extending between the strut 28 and one of the first and second leg members 12, 14, intermediate the ends 16, 18 of the leg members 12, 14. Brace 10*a* may further include a web 62 extending between the first and second leg members 12, 14 and the bridging member 26, such that the web 62 fills the area bounded by the legs 12, 14 and bridging member 26, including spaces between any reinforcing members 60.

While the present invention has been illustrated by the description of the various embodiments thereof, and while the embodiments have been described in considerable detail, it is not intended to restrict or in any way limit the scope of the appended claims to such detail. For example, while the angle $\propto$ between the first and second leg members 12, 14 has been depicted as being approximately 90 degrees, it will be understood that the angle $\propto$ may be greater than 90 degrees or less than 90 degrees, as desired, to create a concrete panel having a side edge with a desired angle.

Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A brace for securing concrete forms to a base, comprising:

first and second leg members having first and second ends, said leg members joined at said first ends and spaced to form an angle therebetween;

a bridging member extending between said first and second leg members, proximate said second ends of said leg members and integrally molded with said first and second leg members;

at least one aperture proximate said second ends of said first and second leg members, said aperture sized to receive a fastener therethrough; and a strut extending from said first ends of said leg members to said bridging member.

2. The brace of claim 1, wherein said first and second leg members have enlarged portions proximate said second ends, said aperture formed through said enlarged portions.

3. The brace of claim 1, further comprising:

first and second raised rib portions, extending along said first and second leg members, respectively.

4. The brace of claim 3, further comprising:

first and second flange portions proximate said first ends of said leg members, on opposing sides of said first and second rib portions.

5. The brace of claim 4, further comprising:

a third rib portion, extending along said bridging member.

6. The brace of claim 1, wherein said angle formed by said first and second leg members is approximately 90 degrees.

7. The brace of claim 1, wherein said angle formed by said first and second leg members is greater than 90 degrees.

8. The brace of claim 1, wherein said angle formed by said first and second leg members is less than 90 degrees.

9. The brace of claim 2, wherein said enlarged portions of said first and second leg members are shaped to facilitate removal of the fastener installed through said aperture.

10. A brace for securing concrete forms to a base, comprising:

first and second leg members having first and second ends, said leg members joined at said first ends and spaced to form an angle therebetween;

a bridging member extending between said first and second leg members, proximate said second ends of said leg members and integrally molded with said first and second leg members;

at least one aperture proximate said second ends of said first and second leg members, said aperture sized to receive a fastener therethrough; and a web extending between said first and second leg members and said bridging member to substantially fill an area bounded by said legs and said bridging member.

11. The brace of claim 1 formed from polymeric material.

12. The brace of claim 1, further comprising:

at least one generally elongate reinforcing member extending between said strut and one of said first and second leg members.

13. The brace of claim 4, further comprising:

at least one aperture formed into said first and second flange portions, said aperture sized to receive a fastener therethrough.

14. An assembly for forming concrete structures, comprising:

at least one concrete form arranged on a surface; and at least one brace for securing said concrete form, said brace comprising:

first and second leg members having first and second ends, said leg members joined at said first ends and spaced to form an angle between said leg members, a bridging member extending between said first and second leg members, proximate said second ends of said leg members and integrally molded with said first and second leg members, a strut extending from said first ends of said leg members to said bridging member; and at least one aperture proximate said second ends of said first and second leg members, said aperture sized to receive a fastener therethrough.

15. The assembly of claim 14, wherein said first and second leg members have enlarged portions proximate said second ends, said aperture formed through said enlarged portions.

16. The assembly of claim 14, further comprising:

first and second rib portions, extending adjacent said first and second leg members, respectively.

17. A construction assembly comprising:

a casting surface;

form members having inner and outer faces positioned on said casting surface with said faces disposed substantially normally with respect thereto and said inner faces defining a concrete casting form;

molded plastic, truss-reinforced form braces positioned outwardly of said concrete casting form;

said braces each comprising a form-engaging leg and a casting surface-engaging leg;

said legs having inner opposing surfaces, outer surfaces and side edges;

said outer surfaces of said form-engaging legs being disposed in supporting engagement with said outer faces of said form members;

said outer surfaces of said casting surface-engaging legs engaging said casting surface; and a truss member formed integrally with said legs at said opposing surfaces thereof and intermediate said side edges thereof;

said truss member comprising a bridging member extending between said opposing surfaces of said legs and a strut extending between a medial portion of said bridging member and said legs;

said truss member further including at least one elongate reinforcing member extending from said strut to one of said legs.

18. The assembly of claim 17, wherein:

said legs have enlarged outer ends and reduced intermediate sections.

19. The assembly of claim 17, wherein:

said truss member further comprises raised ribs extending along said opposing surfaces and formed integrally therewith and with said strut.

20. The assembly of claim 18, wherein:

said enlarged outer ends have fastener-receiving openings formed therethrough.

21. The assembly of claim 20, wherein:

said fastener-receiving openings extend to said side edges of said legs.

22. A concrete construction assembly comprising:

a concrete casting slab surface;

a plurality of form members each having inner and outer faces, with said form members positioned on said casting surface and said inner and outer faces disposed substantially perpendicularly with respect to said casting surface;

said inner faces of said form members defining a concrete casting form for the reception of concrete in a plastic state;

a plurality of one-piece molded plastic form braces positioned on said casting surface outwardly of the casting form defined by said form members;

each of said braces comprising a pair of relatively thin flat legs each having enlarged outer ends and reduced intermediate portions and joined to each other at one of said enlarged outer ends of each of said legs;

said legs each having inner opposing surfaces, outer surfaces and side edges;

fastener-receiving openings formed through said enlarged ends of said legs and extending to said side edges thereof;

said outer surfaces of said legs of each of said braces engaging said outer faces of said form members and secured thereto by a fastener extending through said fastener-receiving openings and into said form members;

an outer surface of the other of said legs overlying said casting surface and secured thereto by fasteners extending through said fastener-receiving openings and into said casting surfaces; and a truss member molded integrally with said legs and joined thereto medially of said side edges at said opposing inner surfaces of said legs;

said truss member including a relatively flat thin bridging member extending between distal portions of said legs, raised ribs extending along said inner surfaces of said legs medially of said side edges thereof and a strut member extending from the juncture of inner ends of said legs to said bridging member;

whereby said integrally formed legs and truss member provide a lightweight, relatively rigid, force resistant construction.

23. The concrete construction assembly of claim 22, wherein said truss member further includes at least one elongate reinforcing member extending between said strut and one of said first and second members.

* * * * *